United States Patent [19]

Harris

[11] 4,033,530

[45] July 5, 1977

[54] PROTECTIVE MOUNTING FOR OUTBOARD MOTORS

[76] Inventor: Garrett H. Harris, 157 S. Denver St., Jackson, Miss. 39209

[22] Filed: Feb. 18, 1975

[21] Appl. No.: 550,666

[52] U.S. Cl. ..... 248/4; 115/17

[51] Int. Cl.[2] ..... B63H 21/26

[58] Field of Search ..... 248/4, 279, 280, 281, 248/202; 267/171, 69, 70, 73; 115/17, 18 R

[56] References Cited

UNITED STATES PATENTS

| | | | |
|---|---|---|---|
| 2,372,214 | 3/1945 | Loepsinger | 267/171 |
| 3,120,951 | 2/1964 | Finch | 267/70 |
| 3,139,062 | 6/1964 | Keefe | 248/4 |
| 3,220,717 | 11/1965 | Altherr et al. | 267/70 |
| 3,355,767 | 12/1967 | Niemeyer | 248/20 |
| 3,424,412 | 1/1969 | Gayle | 248/4 |
| 3,856,242 | 12/1974 | Cook | 248/20 |
| 3,859,952 | 1/1975 | Celli | 267/70 |
| 3,861,628 | 1/1975 | Krieger | 115/17 |
| 3,874,318 | 4/1975 | Langley | 248/4 |

*Primary Examiner*—Robert A. Hafer
*Attorney, Agent, or Firm*—James W. Pearce; Roy F. Schaeperklaus

[57] ABSTRACT

A mounting assembly for an outboard motor which can be mounted on a boat to support an outboard motor in upright operative relation to the boat outboard thereof and to support the motor in substantially reclining stowed relation to the deck of the boat. The mounting has an index pan member secured to the deck and a base resting in and substantially filling the pan, the base being secured on the deck by a plurality of members extending through the base, index pan and deck cantable relative thereof and spring-biased to urge the base to seat flatwise in the pan but permitting tilting of the base relative to the pan and deck with one or more points of the base in contact within the pan. A main link is pivoted to the base, swingable inboard to motor-stowing position and into horizontal overboard extending relation in which it is also latched in fixed relation to the base. The motor is secured in a bracket pivoted to the end of the link remote from the pivotal connection thereof to the base and pivotally connected to at least one additional link which is also pivotally secured in relation to the base. The latter mentioned link is telescopable and spring-biased toward its telescoped condition and extendible in response to forces applied to submerged portions of the motor in operative position, tending to swing the lowermost submerged portions of the motor upwardly and toward the boat. The end of the latter link pivotally secured relative to the base being secured to a block reciprocable on the base and spring-biased toward a predetermined normal position relative to the base and releasably latched to the base in that position by plungers which retract to release the block when forces tending to shift the block fore and aft from said normal position exceed predetermined threshhold magnitude.

21 Claims, 8 Drawing Figures

PROTECTIVE MOUNTING FOR OUTBOARD MOTORS

This invention relates to outboard motor support structure for boats. More particularly, this invention relates to a retractable support structure for an outboard motor which also supports an outboard motor in operative position under normal forces developed during normal operation and use of the motor, but which will protect the motor from damage in many instances by selectively permitting the motor to move into other positions in response to application of forces of impact or collision of less magnitude than will produce damage to the outboard motor, thereby avoiding increase in the magnitude of such force(s) to damage producing levels.

Briefly, this invention provides a retractable outboard motor mount which in retracted condition holds an outboard motor in a stowed position in a boat and in the extended position latches to secure an outboard motor in operative position outboard of the boat for propelling same. Such mount includes a spring-biased telescoping link extendable by application of forces applied to a submerged portion of the outboard as by collision, to permit swinging of the motor toward the boat about an above water pivot resulting also in elevating the submerged portion of the motor relative to the boat. Such mounting also provides protection to an outboard motor in operative position by permitting pivoting of the motor toward and away from the boat about a horizontal axis by pivotally securing one end of a support link to a bloc spring-biased to a predetermined normal position in which it is locked by latch means which retract to unlock the block when subjected to shifting forces in excess of a predetermined minimum magnitude and the unlatched block then shifts under restraint and bias imposed by spring means supported in relation to the boat. Such mounting also permits tilting of the outboard motor in response to forces of less than damage-producing magnitude so as to tilt the mounting sidewise fore, aft, or in directions involving components of sidewise and fore or aft tilting.

An object of this invention is to provide a mounting structure for a light weight motor which permits ready raising of the motor from the water to swing the motor into the boat when not in use as when propelling the boat by other means or for servicing of the motor.

Another object of this invention is to provide a mounting of the foregoing character latchable to support the motor in the motor-in-operative-position.

Another object of this invention is to provide a mounting of the foregoing character in which the latch means advance into tighter latching engagement in response to vibration.

Another object of this invention is to provide a mounting which supports the outboard motor in operative position under forces resulting from interaction of the water with immersed portions of the outboard motor either incident to propulsion or drag, but permits swinging of the motor about a substantially horizontal transverse axis under collision of an immersed part of the motor with an object approached by the boat.

Another object of this invention is to provide a mounting of the foregoing character in which at least one link having a substantially predetermined limited minimum length under compression loads greater than a negative compression load of predetermined magnitude (that is, a tension load that is less than a predetermined magnitude) and elastically resists extension which occurs under tension loads greater than said predetermined magnitude.

Another object of this invention is to provide a mounting of the foregoing character in which the extendible link comprises a pair of telescopically cooperating members urged toward telescoped relation by resilient means and cooperable with a shock absorbing means in and adjacent their fully telescoped position.

Another object of this invention is to provide a mounting of the foregoing character in which a main link extends outboard of a boat, an outboard motor is pivotally secured relative to said main link, a second link is pivotally secured relative to said outboard motor about an axis parallel to and spaced from said pivot connecting said motor to said main link, said second link being pivotally connected to a member spring-biased toward a predetermined relation to said boat, latch means latching said member to said boat in said position so long as forces tending to shift said spring-biased member from said position are of less than predetermined magnitude and said spring biasing offers increasing resilient resistance to shifting of said member from said position relative to said body when forces tending to shift said member from said position exceed said predetermined magnitude.

Another object of this invention is to provide means securable in fixed relation to a portion of an outboard motor to cooperate with the mounting to establish the desired lower limit position of the motor relative to the mounting and its position of rotation about an upright axis relative to the mounting while supported in operative position by the mounting.

Another object of this invention is to provide a device in accordance with the preceding object in which said means may be left in position relative to the outboard motor indefinitely while the motor is repeatedly placed in and removed from said mounting to index the outboard motor into desired predetermined relation to the mounting which has releasable means for securing the outboard motor to the mounting in desired predetermined relation.

The above and other objects and features of the invention will be apparent to those skilled in the art to which this invention pertains from the following detailed description and the drawings of what presently appears to be a preferred embodiment of the invention.

In the drawings.

In the following detailed description and the drawings, like reference characters indicate like parts.

Figures 1, 2, 8:
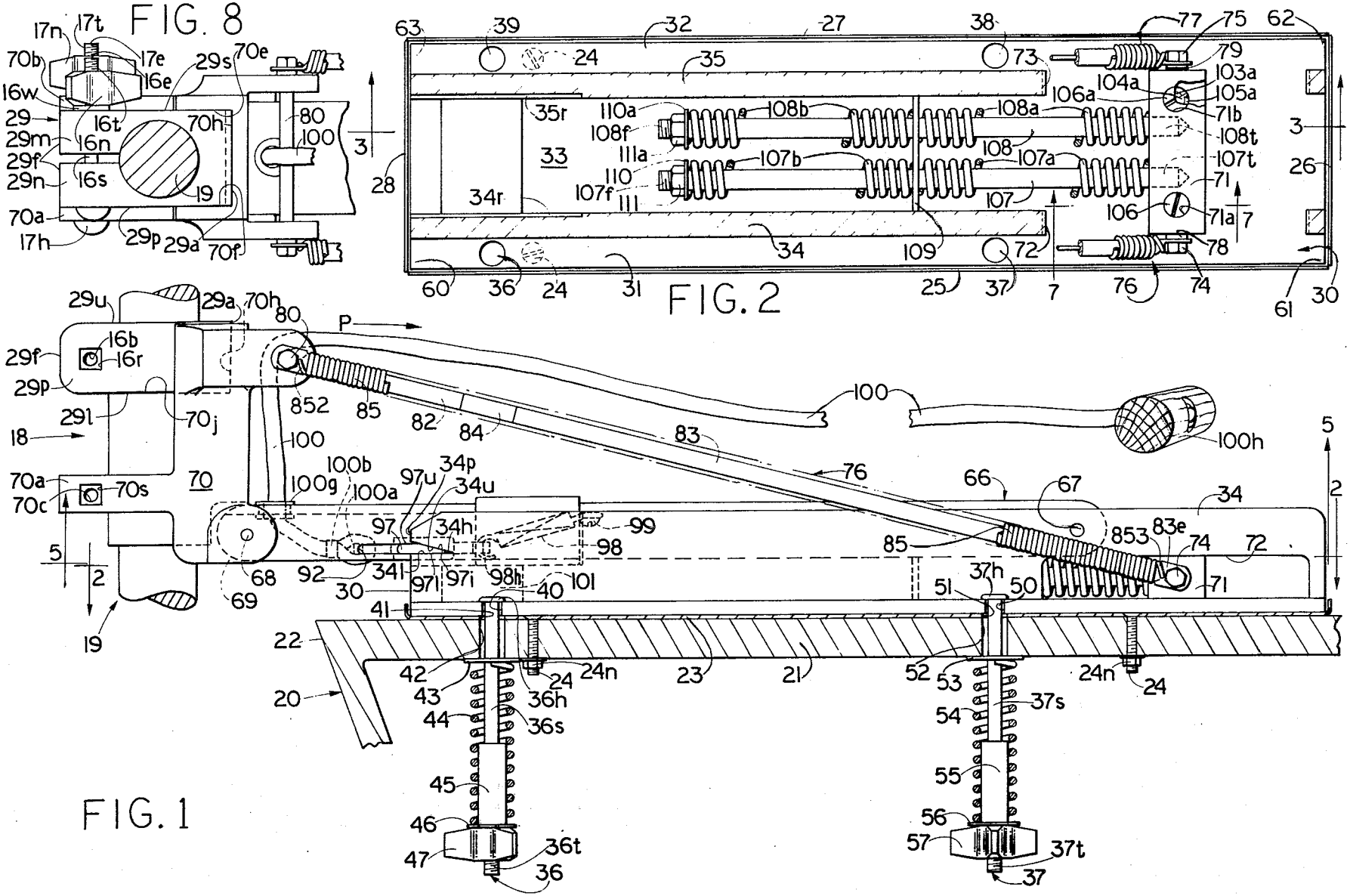
FIG. 1 is a view in side elevation, partly in section, of a deck portion of a boat with a motor mounting assembly constructed in accordance with an embodiment of this invention secured in motor mounting relation thereto and in the condition for supporting a motor in normal propulsion operating relation to the boat.
FIG. 2 is a view in substantially horizontal transverse section taken on the line 2—2 in FIG. 1.
FIG. 8 is a fragmentary top plan view of the device of FIG. 1 taken generally on the line 8—8 in FIG. 1.

In FIG. 1 is shown a bow portion of a boat 20 which includes a deck 21 on which a mounting assembly 18 is provided for an outboard motor 19 adjacent the bow 22 thereof. An index plate 23 is secured on top of deck 21 by bolts 24. The bolts 24 secure the index plate 23 in fixed relation to the deck 21. As shown in FIGS. 1, 2, 3 and 6, index plate 23 has upstanding marginal flanges 25, 26, 27, 28.

Base 30 rests upon index plate 23 and is received between the lateral flanges 25, 27 thereof and between the fore flange 28 and aft flange 26 thereof. Base 30 is secured so as to normally remain in substantially fixed relation on the index plate but for pivoting relative thereto, as is hereinafter explained, by means of four anchoring assemblies which couple base 30 to deck 21 and associated index plate 23.

Base 30 has a generally horizontal planar portion including side flanges 31, 32 and a central web portion 33. Integral upstanding flanges 34, 35 extend fore and aft, respectively, between flange 31 and central web portion 33 and between that web portion 33 and side flange 32. The base 30 may be cast or otherwise constructed.

Bolts 36, 37, 38 and 39 are portions of the respective four anchoring assemblies, two of which are shown in detail in FIG. 1. Bolt 36 has a head **36*h* which engages the upper surface of flange 31 and a shank 36*s* which extends from head 36*h* successively downward through separate aperture 40 in flange 31, aperture 41 in index plate 23, aperture 42 in deck 21, bearing washer 43, compression spring 44, bushing 45, bearing washer 46, and hand nut 47. Adjacent its lower end, remote from head 36*h*, a portion of shank 36*s* has threads 36*t* provided thereon for cooperation with nut 47. Bushing 45 may be made of nylon or similar material having shock absorbing elastic property such that in the event the force end of base 30 is forced upwardly, pivoting base 30 about its aft edge adjacent flange 26 or its flange 31 is forced upward so base 30 pivots about the lateral edge (of flange 32) adjacent index plate flange 27, bolt 36 will be advanced generally axially upward, with some canting, as would be obvious, plate to deck 21 and index plte 23. Such advancement of bolt 36 results in compression of spring 44 and corresponding advancement of nut 47, bearing washer 46, and bushing 45 toward bearing washer 43 which is in engagement with the underside of deck 21. Upward advancement of bolt 36 would be limited by bushing 45, as when the latter is advanced into engagement with bearing washer 43, resiient resistance of bushing 45 to longitudinal compression thereof between bearing washers 43 and 46 would offer greatly increased resistance to further movement of bolt 36 and base 30 to which bolt 36 is coupled by head 36*h*. In similar fashion, where pivoting of base 30 is about its lateral edge adjacent index plate flange 27, bolt 37, coupled by engagement of its head 37*h* with flange 31, is also advanced generally axially upward through aperture 50 in flange 31, aperture 51 in index plate 23, aperture 52 in deck 21 and bearing washer 52 with some canting of the head end toward flange 27 while nut 57, coupled to shank 37*s* by threads 37*t*, advances bearing washer 56 and busing 55 toward bearing washer 53 with concurrent axial compression of spring 54. While such concurrent upward advancement of bolts 36 and 37 is occurring, lesser upward advancement of bolts 38 and 39 also occurs. If corner 63 (FIG. 2) is raised further from index plate 23 than corners 63 and 61 while corner 62 remains on plate 23, bolt 36 would be raised further than bolt 39 which in turn would be raised further than bolt 37 while bolt 38 would be raised the least. Depending upon the resultant force applied to base 30, the latter is tiltable relative to index plate 23 within limits imposed by bolts 36, 37, 38, 39, while the threshold force necessary to effect tilting is established by the magnitude of pre-loading on each of the compression springs 44, 48, 54, 58, provided by the position of axial adjustment of the nut 47, 57, 64, 65 upon the respective bolt 36, 37, 38, 39** as the case may be.

Upwardly extending flanges 34, 35 (FIGS. 1, 3 and 5) of base 30 support a pivot pin 67 upon the central portion of which one end of link member 66 is pivotally supported. Pivot pin 68, carried by the other end, the swingable end 69 of link member 66, cooperates with and pivotally secures bracket 70 to link member 66.

Figure 4:
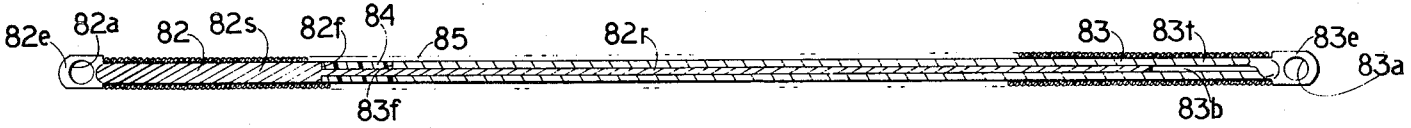
FIG. 4 is a view taken on the line 4—4 in FIG. 5 of an elongatable link assembly.

An anchor block 71 is mounted on base 30 and entends transversely with its end portions received in slots 72, 73 in upwardly extending flanges 34 and 35. Aligned threaded recesses are provided in co-axial relation in the respective end faces of block 71 to cooperatively receive the threaded shanks of bolts 74, 75. The anchor block 71 is coupled to bracket 70 by a pair of link assemblies 76, 77 which are substantial duplicates of one another. The link 76 has adjacent one of its ends pivotally secured by bolt 74 to block 71, a spacing collar 78 supporting link assembly 76 so as to avoid rubbing of its parts upon other portions of the mounting structure. A bolt 80 cooperates with bracket 70 and pivotally attaches the opposite end lug portion **82*e* of link assembly 76 and the corresponding lug portion 68*e* of link assembly 77 to that bracket. Link assembly 76 is shown partly broken away in FIGS. 1 and 5 and substantially in section in FIG. 4. As shown in FIG. 4, link assembly 76 includes a pair of telescoping members 82, 83, a shock absorbing or cushioning collar 84, and a helical tension spring 85. Member 82 has a flat lug end 82*e* in which bolt receiving aperture 82*a* is provided. Adjacent lug portion 82*e* is an elongate cylindrical shoulder portion 82*s* and extending axially from shoulder portion 82*s* and away from lug portion 82*e* is rod portion 82*r*. Shock absorbing collar 84 of nylon, urethane or the like is mounted annularly of rod 82*r*. The second telescoping portion of link assembly 76, portion 83, has a flat end lug portion 83*e* in which bolt receiving aperture 83*a* is provided. The lug portion 83*e* is integral with a tubular body portion 83*t* in which is provided bore 83*b* adapted to receive rod portion 82*r* in sliding telescoping relation. The end of tubular portion 83*t* remote from lug 83*e* has a flat transverse radial end face 83*f* adapted to abuttingly cooperate with the opposed end face of shock absorbing collar 84. The members 82 and 83 are preferably made of metal while, as mentioned above, the collar 84 is made of nylon, urethane, or other material, which will result in resilient resistance to reduction of the axial dimension of the collar when the opposed faces 82*f*, 83*f* abutting it are urged to move nearer together than the length of the collar 84. Annularly of the assembly of telescoping members 82, 83 and collar 84, and biasing them toward abutting relation, is helical tension spring 85, the coils of which lie in slightly spaced but almost-touching relation to each other and the end portions 852, 853 of which cooperatively embrace the lug end portions 82***e* and 83*e*, respectively anchoring the spring ends thereto, as shown particuarly in FIGS. 1, 2 and 5.

Similarly, link assembly 77 has a telescoping portion 86, the end lug 86*e* of which is also secured by bolt 80 to bracket 70. The lug 86*e* is supported in spaced relation to bracket 70 by spacing collar 90 (just as lug 82*e* is spaced from bracket 70 by collar 91) while nut 81 retains lug 86*e* on bolt 80. Section 86 has a rod portion 86*r* (FIG. 5) extending into tubular portion 87, and end lug 87*e* of which is attached to anchor block 71 by bolt 75. Spacing collar 79 supports lug 87*e* in spaced relation to block 71 so as to preclude rubbing of any portions of the link assembly 77 against other portions of the mounting. Shock absorbing cushioning collar 88, corresponding to collar 84, is provided between portions 86 and 87 and annularly of the rod portion of 86*r*. Helical tension spring 89 is provided annularly of portions 86, 87 and 88 of link assembly 77, and the end portions 896 and 897 respectively engage the lug portions of elements 86 and 87 in a firm embracing grip so as to anchor the ends of that spring 89 to the telescoping members with the coils of the spring slightly spaced as spring 89, in tension, resiliently urges members 87 and 86 toward each other to normally place collar 88 under compressive forces.

Figure 5:
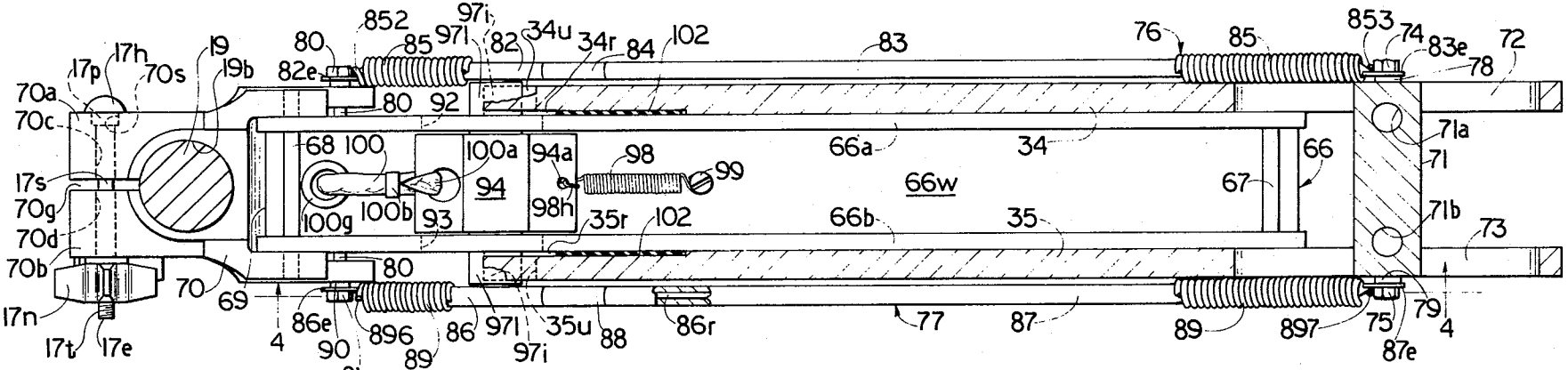
FIG. 5 is a view in substantially horizontal transverse section taken generally on the line 5—5 in FIG. 1.
Figures 6, 7:
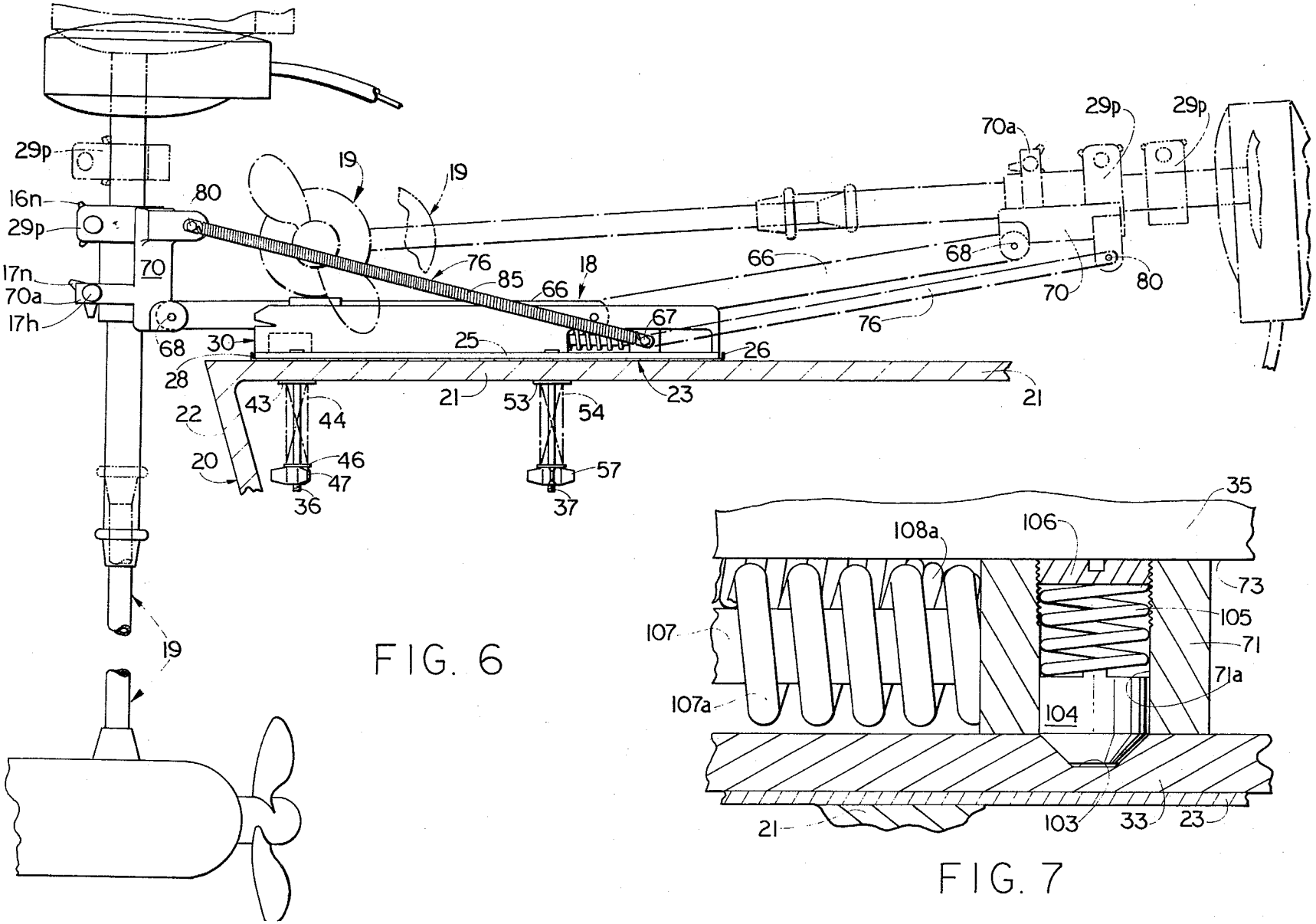
FIG. 6 is a view in side elevation of the illustrative embodiment (similar to FIG. 1), showing an outboard motor supported in operative relation to the boat in full lines and in dot-dash lines showing the motor and associated portions of the mounting in motor-stored relation, with fragmental showings of the motor in partly released position, shown in dot-dot-dash and dot-dot-dot-dash lines.
FIG. 7 is a fragmentary view in section taken along the line 7—7 in FIG. 2 showing details on construction of portions of the mounting.

As shown in FIGS. 1, 5 and 6, bracket 70 is a split clamp for securing outboard motor 19 to the mounting 18. A portion of outboard motor 19 is received in bore 19*b* of bracket 70 inboard of arms 70*a*, 70*b*, which arms may be drawn toward each other to securely clamp the motor 19 in fixed relation to bracket 70 by appropriate rotation of hand nut 17*n* in cooperation with thread 17*t* of bolt 17. The head 17*h* of bolt 17 engages the outer face of arm 17*a* (FIG. 5) while the shanks 17*s* of the bolt 17 extends through bores or apertures 70*c*, 70*d* provided in arms 70*a*, 70*b*. Thread 17*t* on the bolt extends from bolt free end 17*e* toward head 17*h* to a point inside of bore 70*d*. Bolt 17 has a squared portion 17*p* adjacent head 17*h*. Portion 17*p* is cooperatively received in enlarged-squared portion 70*s* of bore 70*c* to secure the bolt 17 against rotation relative to bracket 70.

The upper portion of bracket 70 is an indexing seat for indexing collar 29. As shown in FIGS. 1 and 8, collar 29 may be rectangular with parallel upper and lower faces 29*u*, 29*l*, upright side faces 29*p*, 29*s*, upright end faces 29*f*, 29*a* and bore 29*b* in which the outboard motor 19 is received. Collar 29 is slotted or split at 29*c* to provide arms 29*m*, 29*n*. The head 16*h* of clamp bolt 16 engages face 29*p* and an adjacent square shank portion is cooperatively received in recess 16*r* to secure the bolt against rotation in bore 16*b*. Shank 16*s* extends from head 16*h* to end 16*e* (FIG. 8). Nut 16*n* cooperates with threads 16*t* to bolt 16 and thrust washer 16*w* so that appropriate rotation of nut 16*n* draws arms 29*m*, 29*n* toward each other to clamp collar 29 on outboard motor 19 or permits arms 29*m*, 29*n* to move away from each other to unclamp collar 29 from motor 19.

Bracket 70 has opposed faces 70*e*, 70*f* joined by face 70*h*, all angularly related to each other and to upward facing face 70*j*. Faces 70*e*, 70*h* and 70*f* of bracket 70 respectively cooperatively engage faces 29*s*, 29*a* and 29*p* of collar 29 to index that collar in the position shown in FIG. 8, and, as collar 29 is clamped in fixed relation to motor staff 19, the latter is also similarly indexed in predetermined relation to bracket 70. When the motor and collar are advanced downward with rotation from the dot-dot-dash position in FIG. 6 to the full line position in which collar face 291 rests upon bracket face 70*j*, a limit on downward advancement of motor 19 is established and the motor may be clamped in "indexed" fixed relation to bracket 70 by appropriate rotation of nut 17*n*. By loosening nut 17*n*, the motor 19 can be removed from the mounting, as for storage or other purposes, or released for shifting to a position such as the servicing position shown in dot-dot-dot-dash lines in FIG. 6 wherein it is not indexed realative to the mounting, but reinstallation in the same indexed relation to the mounting is assured by reason of the undisturbed indexing collar 29 being advanceable from a position such as the dot-dot-dash or the dot-dot-dot-dash position (FIG. 6) respectively to the full line or the dot-dash position only in the predetermined indexed related position, and tightening of nut 17*n* resecures the motor in the mount. If vertical or directional adjustment of the indexed position of the motor relative to the mounting is desired, nuts 17*n* and 16*n* can be loosened in sequence, the motor placed in the relative position desired, the nut 16*n* tightened and then nut 17*n* tightened.

When the mounting is in the condition illustrated in FIG. 1, supporting an outboard motor 19 in upright position, the position in which it is normally operated to propel the boat, the bracket 70 is braced against swinging in a clockwise direction about pivot pin 68 by the link assemblies 76 and 77. However, if due to colision of the immersed part of the outboard motor 19 with an underwater object while the boat is advancing from right to left (in FIG. 1), the motor tends to swing with bracket 70 counterclockwise about pivot 68. The strength, that is, the resistance of springs 85 and 89 to elongation, is selected so that under forces applied when the outboard motor 19 is propelling the boat backward, from left to right in FIG. 1, at full throttle the springs 85, 89 do not elongate to free either shock-absorbing collar 84 or 88 from compression between the adjacent telescoping member 82–83, 86–87 but under forces applied through collision of submerged motor 19 with an underwater object while the boat is traveling forward, right to left in FIG. 1, counterclockwise pivoting of the bracket 70 about pivot 68 results before the force applied to the outboard motor 19 by collision with the submerged object reaches magnitudes as would result in damage of undesired degree to the motor. In effect, the forces approaching damage producing magnitude produce elongation of the springs 85, 89 and concurrent telescopic extension of the members 82, 83 of link 76 and 86, 87 of link 77. Such swinging of the outboard motor with bracket 70 about the pin 68 results in raising of the motor relative to the boat hull and often will permit the motor to simply ride trailingly over the submerged object, and while doing so, the propeller being at the end of the motor nearest to the boat hull, the propeller end of the motor is canted higher, thereby affording additional protection to that more fragile part of the structure. Once the motor passes over the submerged object with which it has collided, the springs 85, 89 urge the telescoping members 82, 83 of link 76 and 86, 87 of link 77 to telescope and move toward each other with substantial force. The force of the movement is supplemented by propulsion forces resulting from motor operation and by momentum forces stored in the outboard motor and associated structure which undergoes movement about pivot 68 with brackets 70 such that if no cushioning or shock absorbing provision was made, a harsh and substantial metal-to-metal shock would result. However, the collars 84 and 88 are provided to interpose firm but resilient braking of the telescoping movement as the telescoping pairs of members approach the normal position corresponding to that shown in FIGS. 1, 4 and 5.

From experience in the field, the great majority of instances where such outboard motors, particularly, those of the electric trolling motor type, are damaged by collision with immersed objects, occur while the boat is being propelled in a forward direction, and the provision of link assemblies such as 76, 77 protect such motors from a very substantial amount of the damage to which they are otherwise exposed.

With the development of more powerful electric motors for use in outboard trolling or fishing motors, difficulty has from time to time been experienced with the more powerful motors in that when developing full power, the weight, gravity force which would secure less powerful motors in desired operating position is insufficient and the more powerful motors tend to rise in the water and swing mounting member, such as 66, clockwise about pivot 67 as viewed in FIG. 1. The advantage of the increased power thus frequently undergoes reduction through effective power loss firstly due as a result of such swinging of the mounting to misdirect motor produced thrust and further by aeration as the propeller nears the water surface. To preclude such rising action, latch means have previously been utilized, as disclosed in U.S. Pat. No. 3,724,790, of which I am one of the patentees.

In order to securely latch link member 66 in the relative position in which it is shown in FIG. 1, I have provided an improved latching structure which tightens under vibrations incident to operation of the outboard motor 19 for propulsion of the boat. The link member 66 shown is generally of inverted channel shape in transverse section with a substantially horizontal top web 66*w* and side flanges 66*a*, 66*b* depending vertically therefrom. In each of the side flanges 66*a*, 66*b* I provide one of a pair of longitudinal slots 92, 93. A latch body 94 substantially spans the space between the vertical flanges 95, 96 of link 66 and carries a transverse latch bar 97. As shown in FIG. 5, the latch bar extends substantially from the plane of the outer face of rib 34 through slot 92, latch 94, slot 93, and beyond to the plane of the outer surface of flange 35. Latch bar 97 has a broad flat planar lower surface 97*l*, as viewed in FIG. 1, and a parallel upper surface 97*u* of lesser extent from left to right, as viewed in FIG. 1. The surfaces 97*l* and 97*u* are parallel and adpated to both slidingly engage respectively the lower and upper surfaces defining slot 92, as viewed in FIG. 1. Thus, the cooperation between surfaces 97*l* and 97*u* in slots 92, 93 with flanges 66*a* and 66*b* support the latch body for reciprocation longitudinally of the slots 92, 93. Tension spring 98 anchored by screw 99 to link member 66 has a hook portion 98*h* extending through aperture 94*a* provided in latch body 94 which the spring 98 resiliently urges to move toward the right, as viewed in FIGS. 1 and 5. The upright flanges of body 30, namely, flanges 34 and 35, have provided in their leading or fore ends like V-shape notches 34*n*, 35*n*, the notch 34*n* in flange 34 being shown in full lines in FIG. 1 and notch 35*n* being shown in full lines in FIG. 3. The lower surfaces 34*l*, 35*l* 351 bounding notch 34*n*, 35*n*, are substantially horizontal and coplanar, adapted for flatwise engagement by surface 97*l* of latch bar 97 while upper surfaces 34*u*, 35*u* defining notches 34*n*, 35*n* are coplanar and inclined downwardly from left to right as viewed in FIGS. 1 and 3 and adapted for flatwise engagement by surfaces 97*i* of bar 97. To draw latch body 94 with its latch bar 97 toward the left as viewed in FIGS. 1 and 5, a flexible rope or the like 100 adjacent one of its ends extends through aperture 94*b* in latch body 94 and is formed into a permanent end loop 100*a* by crimped anchor band 100*b*. From end loop 100*a*, rope 100 extends through friction reducing grommet 100*g* (which may be of nylon or other suitable material) in web 66*w*, over the shank of bolt 80 and to handle 100*h* as shown in FIG. 1. When rope 100 is placed in tension so as to be moved in the direction of arrow P (in FIG. 1), latch body 94 with its latch bar 97 is advanced toward bracket 70. Such tensioning of rope 100 results when, as motor 19 is shifted from the stowed position shown in dot-dash lines in FIG. 6 to the operating (full-line) position, the rope 100 is used by an operator holding and manipulating handle 100*h* to restrain the gravity urged descent of the motor 19 into the water. Thus as link 66 approached the position of FIG. 1, tension in rope 100 causes latch body 94 and latch bar 97 to move to the position in which latch bar 97 engages the left ends of slots 92, 93 as viewed in FIGS. 1 and 5. In that position bar 97 clears portions 34*p*, 35*p* of flanges 34, 35 as it advances into position for entry rightward (as viewed in FIG. 1) into the notches 34*n*, 35*n*. As tension in the rope 100 is then relaxed spring 98 advances bar 97 into notches 34*n*, 35*n* so that surface 97*i* wedgingly flatwise engages surfaces 34*u*, 35*u* to draw link 66 downward toward the position in which surface 97*l* of latch bar 97 flatwise engages surfaces 34*l*, 35*l* and bar 97 is in tight, wedged engagement in the notches 34, 35 and link 66 is in substantial engagement with rest 101.

To provide resistance to lateral movement of link 66 between flanges 34 and 35, which are spaced slightly farther apart than the distance from the outer face of link flange 66a to the outer face of link flange 66*b*, a resilient abutment such as a flat band of rubber 102 may be provided in overlying relation to the lateral side faces, that is, the outer faces, of link flanges 66*a*, 66*b* adjacent the latch location. The base flanges 34 and 35 are provided with shallow recesses 34*r*, 35*r* adjacent the latch notches 34*n*, 35*n* and the thickness of the resilient band 102 is such that the sum of their thicknesses is slightly greater than the sum of the spans between the side faces of the link and the opposite faces of the recesses 34*r*, 35*r* so that the resilient member 102, under some compressive load, serves to damp any tendency of the link 66 to vibrate or shift sidewise between the flanges 34, 35 when in the position shown in FIGS. 1 and 5.

In order to provide fore and aft swinging of the outboard motor from the position of FIG. 1 while latch bar 97 is engaged in notches 34*n*, 35*n*, as would be desirable to protect the motor from serious damage due to collision with underwater obstructions, anchor block 71 may be provided with latches which release in response to loads in excess of a predetermined magnitude to permit the fore and aft shifting of anchor block 71 under a varying resilient resistance provided by structures such as hereinafter described.

Figure 3:
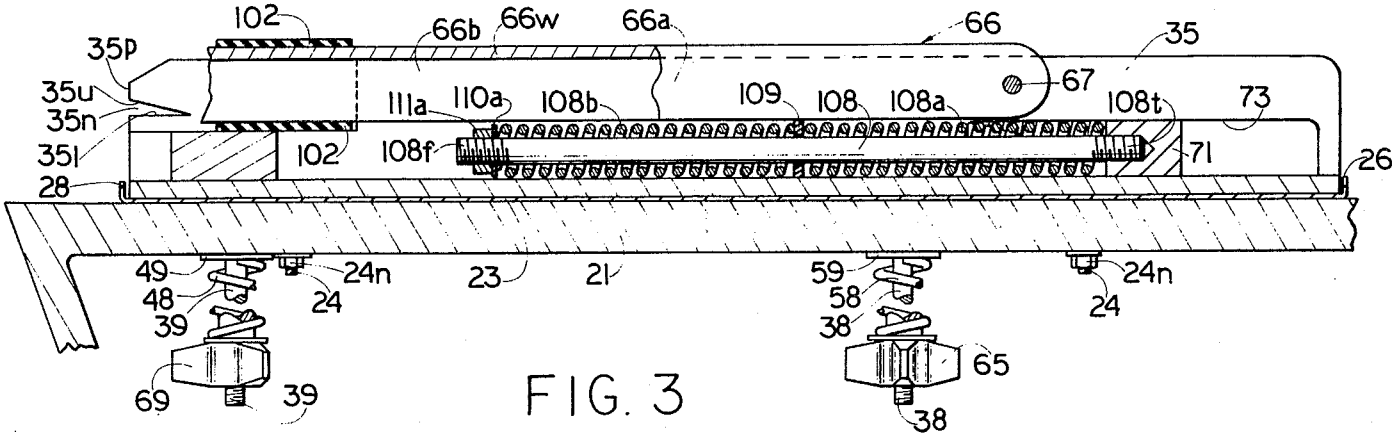
FIG. 3 is a fragmentary view, partly in section, of the device of FIG. 1 taken along the line 3—3 in FIG. 2.

As shown in FIGS. 2, 5 and 7, a pair of wells 71a, 71b may be provided in anchor block 71. When block 71 is in the position illustrated in full lines in FIGS. 1, 2, 3, 5, 6 and 7, respective frusto-conic detents 103 (FIG. 7), 103*a* (FIG. 2) provided in web 33 of base 30 are in registry with wells 71*a* and 71*b*. Plungers 104 (FIG. 7), 104*a* (FIG. 2) each having a lower section of frusto-conic form adapted to mate respectively with the said recess 103 (FIG. 7) or 103*a* (FIG. 2) are respectively mounted for vertical reciprocation in the wells 71*a*, 71*b* and may be as shown in FIG. 7. A helical compression spring 105 (FIG. 7), 105*a* (FIG. 2) is disposed in the well 71*a*; 71*b* on top of the plunger 104, 104*a* and retained in the well and subjected to preloading forces by screw plug 106, 106*a*. The compression preload imposed on each respective spring 105, 105*a* and through it onto the plunger 104, 104*a* is adjustable by the degreee to which screw plug 106, 106*a* is advanced into the well 71*a*, 71*b*, and for this reason the wells 71*a*, 71*b* are threaded for a greater distance than the mere thickness of the plug, as shown in FIG. 7. By adjusting the compression load on each of the springs 105, 105*a*, the force necessary to shift the block 71 to the left or right of the position in which it is shown in the above mentioned views, movement in which the plungers 104, 104*a* are cam retracted into wells 71*a*, 71*b*, may be selected. To guide movement of block 71, under forces of magnitude greater than that required to unlatch plungers 104, 104*a*, a pair of parallel guide rods 107, 108, are provided, each having one end 107*t*, 108*t* threadedly fixed to block 71, as shown in FIGS. 2 and 3. The guide rods 107, 108 extend leftward through respective apertures in guide rib 109 (secured in fixed relation to base 30) and onward to free ends 107*f*, 108*f* carrying bearing washers 110, 110*a* supported by nuts 111, 111*a*. As shown in FIGS. 2 and 3, helical compression springs are provided annularly of each of the guides, one spring 107*a*, 108*a* extending from anchor block 71 to guide rib 109 and another spring 107*b*, 108*b* from the guide rib 109 to the bearing washer 110, 110*a*. The springs 107*a*, 107*b*, 108*a*, 108*b* are selected both for their strength, resistance to compression and also for length in relation to the distance between the opposed faces of rib 109 and block 71 or rib 109 and washer 110, 110*a* with fine adjustment of the loading being accomplished by rotation of nuts 111, 111*a*. During such adjustment, the screw plugs 71*a*, 71*b*, springs 105, 105*a* and plungers 104, 104*a* may be removed from wells 71*a*, 71*b* and the nuts 111, 111*a* rotated to place the block 71 so that the wells 71*a*, 71*b* are respectively in registry with the detents 103, 103*a* in base web 33. The plungers 104, 104*a*, springs 105, 105*a* the screw plugs 106, 106*a* are then replaced in the wells and the screw plugs 106, 106*a* advance downwardly so as to attain the desired preloading of the springs 105, 105*a* as will establish the desired threshhold force necessary to shift block 71 leftward or rightward from the position of FIGS. 1, 2, 3, 5, 6 and 7. Such threshhold force necessary to shift block 71 leftward of the FIG. 1 position is preferably a force of magnitude greater than required to effect counterclockwise pivoting of bracket 70 about pivot pin 68 and substantial elongation of the link assemblies 76, 77 and of magnitude less than would result in damage to the motor 19. Preferably the magnitude of the threshhold force necessary to shift block 71 rightward from the latched position of FIG. 1 is the same, but oppositely directed.

Once the threshhold force is exceeded block 71 will be shifted in the appropriate direction (leftward or rightward from the FIG. 1 position). Where progressively increasing force produces leftward shifting of block 71, accompanying corresponding leftward movement of guide rods 107, 108 and bearing washers 110, 110*a* will occur with reduction of the compression load on springs 107*b*, 108*b* (to zero where the shift of washers 110, 110*a* away from rib 109 is great enough) with concurrent increase in the compression load on springs 107*a*, 108*a* until where the force increases to a great enough magnitude to shift the block 71 to the mechanical limit of its movement in which those springs (107*a*, 108*a*) are fully compressed. The upper surface of web 33 and the under face of flanges 34, 35 bounding the slots 72, 73 at their upper sides respectively cooperate with the opposed adjacent lower and upper faces of block 71 to preclude upward and downward movement of the block and limit same to fore and aft movement. Similarly, decrease in that block 71 shifting force (where its magnitude is within the range above the threshhold level and below that at which the mechanical limit of movement of block 71 is reached) to the threshhold level results in spring biased progressive rightward movement of block 71 to the FIG. 1 position with accompanying progressive expansion of springs 107*a*, 108*a* and compression of springs 107*b*, 108*b* to the condition of FIG. 2 wherein the plungers 104, 104*a* are latchingly engaged in detents 103, 103*a*.

Where motor 19 and bracket 70 (as viewed in FIGS. 1 and 6) are by collision applied forces pivoted clockwise about pivot pin 68 the link assemblies 76, 77 do not telescope, except possibly in the slight degree as collars 84, 88 may be compressed, and when the applied force exceeds the threshhold level block 71 shifts rightward with unlatching retraction of plungers 104, 104*a* into wells 71*a*, 71*b*. When block 71 shifts progressively rightward, guides 107, 108 do likewise and compression loads on springs 107*a*, 108*a* progressively decrease until eliminated while the compression loads on springs 107*b*, 108*b* increase as washers 110, 110*a* are advanced toward rib 109. Rightward movement is limited mechanically by full compression of springs 107*b*, 108*b*. Springs 107*b*, 108*b* expand as the shifting force is reduced until block 71 is returned to and latched in its FIG. 1 position.

Additionally, if the degree to which nut 17*n* is tightened is appropriately selected, the motor 19 may move upward relative to bracket 70 under forces sufficiently great to overcome the frictional resistance established by the tightening of nut 17*n*.

The outboard motor support construction illustrated in the drawings and described above is subject to structural modification without departing from the spirit and scope of the appended claims.

Having described my invention, what I claim as new and desire to secure by letters patent is:

1. A mounting assembly for an outboard motor which comprises a base plate, means for mounting the base plate on a deck of a boat, a first link means, means pivotally mounting the first link means on the base plate, an extendible second link means, means pivotally mounting the extendible second link means on the base plate, a motor support bracket pivotally connected to the first link means and to the second link means, resilient means urging the second link means to a normal position, the link means and the motor mounting bracket being swingable between an operative position in which the motor mounting bracket is adapted to support the motor in upright position outboard of the boat and a storage position in which the motor mounting bracket is adapted to support the motor in substantially horizontal position overlying the deck, pivots between the motor mounting bracket and the link means being vertically spaced when the motor mounting bracket is in operative position, the extendible link being adapted to yield when the assembly is in operative position and the motor hits an obstruction.

2. A mounting assembly as in claim 1 wherein lock means are provided on said link means and adapted to cooperate with said base plate to lock said first link means in operative position relative thereto, resilient means urging said lock means to lockingly engage said base plate, the cooperating faces of said lock means and said base plate being so oriented that said resilient means urged lock means tend to increase its engagement with the base plate under vibratory movement of the link relative to the base plate in increasingly limit the amplitude of said relative vibration.

3. A mounting assembly as in claim 1 wherein the extendible link means includes a first telescoping member pivotally connected to the motor mounting bracket, a second telescoping member pivotally mounted on the base plate, and means for limiting movement of the telescoping members in a link shortening direction at the normal position.

4. A mounting assembly as in claim 3 wherein the resilient means is a helical tension spring surrounding the telescoping members.

5. A mounting assembly as in claim 3 wherein the means for limiting movement of the telescoping members is a resilient annular collar mounted on one of the telescoping members and engageable with the other telescoping member when at normal position to resiliently limit movement of the telescoping members in link shortening direction.

6. A mounting assembly as in claim 5 wherein lock means are provided on said link means and adapted to cooperate with said base plate to lock said first link means in operative position, resilient means urging said lock means to lockingly engage said base plate, the cooperating faces of said lock means and said base plate being so oriented that said resilient means urged lock means tend to increase its engagement with the base plate under vibratory movement of the link relative to the base plate to increasingly limit the amplitude of said relative vibration.

7. A mounting assembly as in claim 6 wherein a collar is provided fixably securable to a portion of an outboard motor which portion of said motor is securable in fixed relation to a bracket supportable on a boat, the bracket being positionable to support the outboard motor in operative position for propelling the boat, the collar and bracket having indexing faces which cooperate to index the motor in the predetermined relation to said bracket corresponding to the relative position in which the collar is secured to the outboard motor.

8. A mounting assembly for an outboard motor which comprises a base plate, means for mounting the base plate on a deck of a boat, the mounting means including resilient means urging the base plate toward the deck of the boat, a first link means, means pivotally mounting the first link means on the base plate, a second link means, means for pivotally mounting the second link means on the base plate, a motor support bracket pivotally connected to the first link means and to the second link means, the link means and the motor mounting bracket being swingable between an operative position in which the motor mounting bracket is adapted to support the motor in upright position outboard of the boat and a storage position in which the motor mounting bracket is adapted to support the motor in substantially horizontal position overlying the deck, pivots between the motor mounting bracket and the link means being vertically spaced when the motor mounting bracket is in operative position, when the assembly is in operative position the resilient means being adapted to secure the base plate on the deck under forces applied by interaction of the motor with water and to protect the motor from damage by yielding to permit the base plate to assume a position nonparallel to said deck in response to greater forces applied when the motor hits an obstruction.

9. A mounting assembly for an outboard motor which comprises a base plate, means for mounting the base plate on a deck of a boat, the mounting means including an index plate for mounting on the deck and means on the index plate for engaging edge portions of the base plate to position the base plate on the deck and resilient means urging the base plate toward the deck of the boat, the base plate being swingable against the resilient means while an edge of the base plate engages the index plate, a first link means, means pivotally mounting the first link means on the base plate, a second link means, means for pivotally mounting the second link means on the base plate, a motor support bracket pivotally connected to the first link means and to the second link means, the link means and the motor mounting bracket being swingable between an operative position in which the motor mounting bracket is adapted to support the motor in upright position outboard of the boat and a storage position in which the motor mounting bracket is adapted to support the motor in substantially horizontal position overlying the deck, pivots between the motor mounting bracket and the link means being vertically spaced when the motor mounting bracket is in operative position, the resilient means being adapted to yield when the assembly is in operative position and the motor hits an obstruction.

10. In a mounting for an outboard motor the combination comprising a bracket, a portion of an outboard motor rotatable and slideable in said bracket, the bracket being positionable to support the outboard motor in operative position for propelling the boat, a collar fixably securable to said portion of an outboard motor, the collar and bracket having indexing faces which cooperate to index the portion of said motor secured to said collar against rotation from a respective predetermined relation to said bracket corresponding to the relative position in which the collar is secured to the outboard motor and to also indexingly limit sliding of the portion of said motor in the direction in which the collar moves into engagement with the bracket.

11. A mounting assembly for an outboard motor which comprises a base plate, means for mounting the base plate on a deck of a boat, a first link means, means pivotally mounting the first link means on the base plate, a second link means, a pivot support member slideably mounted on the base plate, means pivotally connecting the second link means to the pivot support member, spring pressed detent means normally holding the pivot support member in a selected position on the base plate, a motor support bracket pivotally connected to the first link means and to the second link means, the link means and the motor mounting bracket being swingable between an operative position in which the motor mounting bracket is adapted to support the motor in upright position outboard of the boat and a storage position in which the motor mounting bracket is adapted to support the motor in substantially horizontal position overlying the deck, the detent being releasable when the assembly is in operative position and the motor hits an obstruction to permit the pivot support member to advance along the base plate.

12. A mounting assembly as in claim 11 wherein there is spring means mounted on the base plate urging the pivot support member to the selected position.

13. A mounting assembly as in claim 11 wherein the second link means is extendible and includes a first telescoping member pivotally connected to the motor mounting bracket and a second telescoping member pivotally mounted on the pivot support member, a resilient annular collar mounted on one of the telescoping members and engageable by the other telescoping member when at a normal position, and resilient means urging the second link means to the normal position, the second link means being adapted to yield when the assembly is in operative position and the motor hits an obstruction.

14. A mounting assembly as in claim 13 wherein the means for mounting the base plate on the deck of the boat includes an index plate mounted on the deck, means on the index plate for engaging edge portions of the base plate to position the base plate on the deck, and resilient means urging the base plate toward the deck of the boat, the base plate being swingable against the last mentioned resilient means while an edge of the base plate engages the index plate.

15. A mounting assembly as in claim 13 wherein lock means are provided on said link means and adapted to cooperate which said base plate to lock said first link means in operative position, resilient means urging said lock means to lockingly engage said base plate, the cooperating faces of said lock means and said base plate being so oriented that said resilient means urged lock means tend to increase its engagement with the base plate under vibratory movement of the link relative to the base plate to increasingly limit the amplitude of said relative vibration.

16. A mounting assembly as in claim 14 wherein the resilient means urging the second link means to the normal position is a helical tension spring surrounding the telescoping members.

17. A mounting assembly as in claim 16 wherein there is spring means mounted on the base plate urging the pivot support member to the selected position.

18. A mounting assembly as in claim 17 wherein a collar is provided fixably securable to a portion of an outboard motor which portion of said motor is securable in fixed relation to a bracket supported on a boat, the bracket being positionable to support the outboard motor in operative position for propelling the boat, the collar and bracket having indexing faces which cooperate to index the motor in the predetermined relation to said bracket corresponding to the relative position in which the collar is secured to the outboard motor.

19. A mounting assembly as in claim 18 wherein lock means are provided on said link means and adapted to cooperate with said base plate to lock said first link means in operative position, resilient means urging said lock means to lockingly engage said base plate, the cooperating faces of said lock means and said base plate being so oriented that said resilient means urged lock means tend to increase its engagement with the base plate under vibratory movement of the link relative to the base plate to increasingly limit the amplitude of said relative vibration.

20. In a mounting assembly as in claim 19 wherein a collar is provided fixably securable to a portion of an outboard motor which portion of said motor is securable in fixed relation to a bracket supported on a boat, the bracket being positionable to support the outboard motor in operative position for propelling the boat, the collar and bracket having indexing faces which cooperate to index the motor in the predetermined relation to said bracket corresponding to the relative position in which the collar is secured to the outboard motor.

21. A mounting assembly for an outboard motor which comprises a base plate, means for mounting the base plate on a deck of a boat, the mounting means including an index plate mounted on the deck and means on the index plate for engaging edge portions of the base plate to position the base plate on the deck, the mounting means including resilient means urging the base plate toward the deck of the boat, the base plate being swingable against the urging of said resilient means while an edge of the base plate engages the index plate, a motor support bracket, link means mounting the motor support bracket on the base plate, the link means and the motor support bracket being swingable between an operative position in which the motor mounting bracket is adapted to support the motor in upright position outboard of the boat and a storage position in which the motor mounting bracket is adapted to support the motor in substantially horizontal position overlying the deck, the base plate swinging against the urging of said resilient means when the assembly is in operative position and collision of the motor with an obstruction applies force sufficient to swing said base plate while the base plate is in engagement with and supported by the index plate.

* * * * *

UNITED STATES PATENT OFFICE

CERTIFICATE OF CORRECTION

Patent No. 4,033,530 Dated July 5, 1977

Inventor(s) Garrett H. Harris

It is certified that error appears in the above-identified patent and that said Letters Patent are hereby corrected as shown below:

Column 11, line 22, "in" should be --to--.

Column 12, line 46, after "mounting" insert --assembly--.

Column 13, line 39, after "cooperate", "which" should be --with--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*